US006601808B1

(12) United States Patent
Nagel

(10) Patent No.: US 6,601,808 B1
(45) Date of Patent: Aug. 5, 2003

(54) DISPLAY HOOK ASSEMBLY WITH ADJUSTABLE POSITIONING BACK PLATE

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 10/142,442

(22) Filed: May 10, 2002

(51) Int. Cl.[7] ..... F24H 9/06

(52) U.S. Cl. ..... 248/220.31; 248/220.41; 211/57.1; 211/59.1

(58) Field of Search ..... 248/220.31, 220.41, 248/223.31, 221.11; 211/57.1, 59.1

(56) References Cited

U.S. PATENT DOCUMENTS 3,602,370 A * 8/1971 Jerch et al. ..... 211/49.1
3,941,343 A 3/1976 Kennedy
4,194,637 A 3/1980 Edson
4,405,051 A * 9/1983 Thalenfeld ..... 211/57.1
4,452,360 A * 6/1984 Barnes ..... 211/59.1
4,474,351 A * 10/1984 Thalenfeld ..... 248/220.22
4,520,978 A * 6/1985 Taub ..... 248/220.41
4,593,824 A 6/1986 Pfeifer
4,674,721 A * 6/1987 Thalenfeld ..... 248/220.22
4,688,683 A 8/1987 Thalenfeld et al.
4,801,116 A * 1/1989 Blankenship ..... 248/220.22
5,231,779 A * 8/1993 Valiulis et al. ..... 40/649
6,128,843 A * 10/2000 Gebka ..... 40/642.01
6,349,909 B1 * 2/2002 Zarrow et al. ..... 248/220.41

* cited by examiner

*Primary Examiner*—Anita King
(74) *Attorney, Agent, or Firm*—Schweitzer Cornman Gross & Bondell LLP

(57) ABSTRACT

A merchandise display hook assembly is comprised of a wire hook for suspending display merchandise, and a specially molded plastic back plate, which is formed with multiple mounting sockets at different elevations, for varying the vertical position of the display hook relative to the back plate. In one embodiment, the back plate also accommodates laterally adjustable positioning of the display hook relative to the back plate. The arrangement enables in-store display areas to be configured for greater density of display items, leading to significant cost advantages.

15 Claims, 7 Drawing Sheets

DISPLAY HOOK ASSEMBLY WITH ADJUSTABLE POSITIONING BACK PLATE

BACKGROUND OF THE INVENTION

Small merchandise items are frequently displayed for sale by means of apertured panels on which are mounted outwardly extending display hooks. The merchandise items, typically packaged on cards or other special packaging is suspended on the display hooks such that the merchandise can be easily viewed by a customer and individual items can be easily removed by the customer for purchase.

Modern mass merchandising stores place a very high value upon display panel area, and pay close attention to the amount of sales derived from a given area of display wall. In this respect, suppliers seeking to have their product displayed for sale in a large chain store system, for example, may be required to pay very large sums of money in order to have access to relatively small product display area in each of the stores outlets. As a result, the suppliers of merchandise are very concerned with the layout of the display area provided to them, to accommodate the display of a maximum number of articles within the limits of such space. The display board itself provides only a limited range of adjustability. Typically, for example, openings in the board are provided at one inch spacing, such that adjustment of the position of the back plate of the hooks is necessarily done in one-inch increments. In many cases, however, an optimized package spacing may require a much smaller adjustment of the packaging position, possibly as little as an eighth or a quarter of an inch, for example, to avoid interference between side by side displays.

The nature of the above problem was recognized in the Thalenfeld et al. U.S. Pat. No. 4,688,683, which provided a back plate consisting of a metal base and a plastic socket for mounting a display hook, in which the plastic socket is mounted on the metal base for limited lateral sliding movement. While providing some improvement in display density, this proposal had certain disadvantages, among which was the additional cost of a two-part structure for the metal base and the laterally movable plastic socket.

In accordance with the present invention, a novel and improved hook back plate is provided, which is a one-piece molding of plastic material, and which incorporates multiple hook-mounting sockets at different vertical levels on the back plate. While the back plate itself may be repositioned only in one inch vertical increments, the hook supported by the back plate may be selectively positioned in one of the multiple vertical sockets such that, for a given position of the back plate, the hook may be located at two or three different vertical positions on the display panel. The adjustable vertical positioning of the hook, relative to available back plate positions on the perforated panel board, provides a high degree of flexibility in the arrangement of the display space, which is particularly significant in view of the high degree of variability in the length of displayed packages.

In accordance with one aspect of the invention, the one-piece back plate is designed to provide multiple vertical hook-mounting positions, while at the same time being capable of high speed injection molding with relatively uncomplicated molds, such that the back plate may be manufactured at a suitably low cost.

In one embodiment of the invention, the display hook is adapted for mounting in one of a multiple vertical locations on the back plate, while being substantially fixed in its lateral positioning. In another embodiment, the multiple hook-mounting sockets at the several vertical locations on the back plate also provide for a significant lateral adjustment of the hook relative to the back plate such that both vertical and lateral positioning adjustment of the hook is enabled for a given back plate position on the display panel. The arrangement allows the display space allotted to a given supplier to be easily optimized for maximum product display.

For a more complete understanding of the above and other features and advantages of the invention, reference should be made to the following detailed description of preferred embodiments of the invention, and to the accompanying drawings.

DESCRIPTION OF PREFERRED EMBODIMENTS

Figure 1:
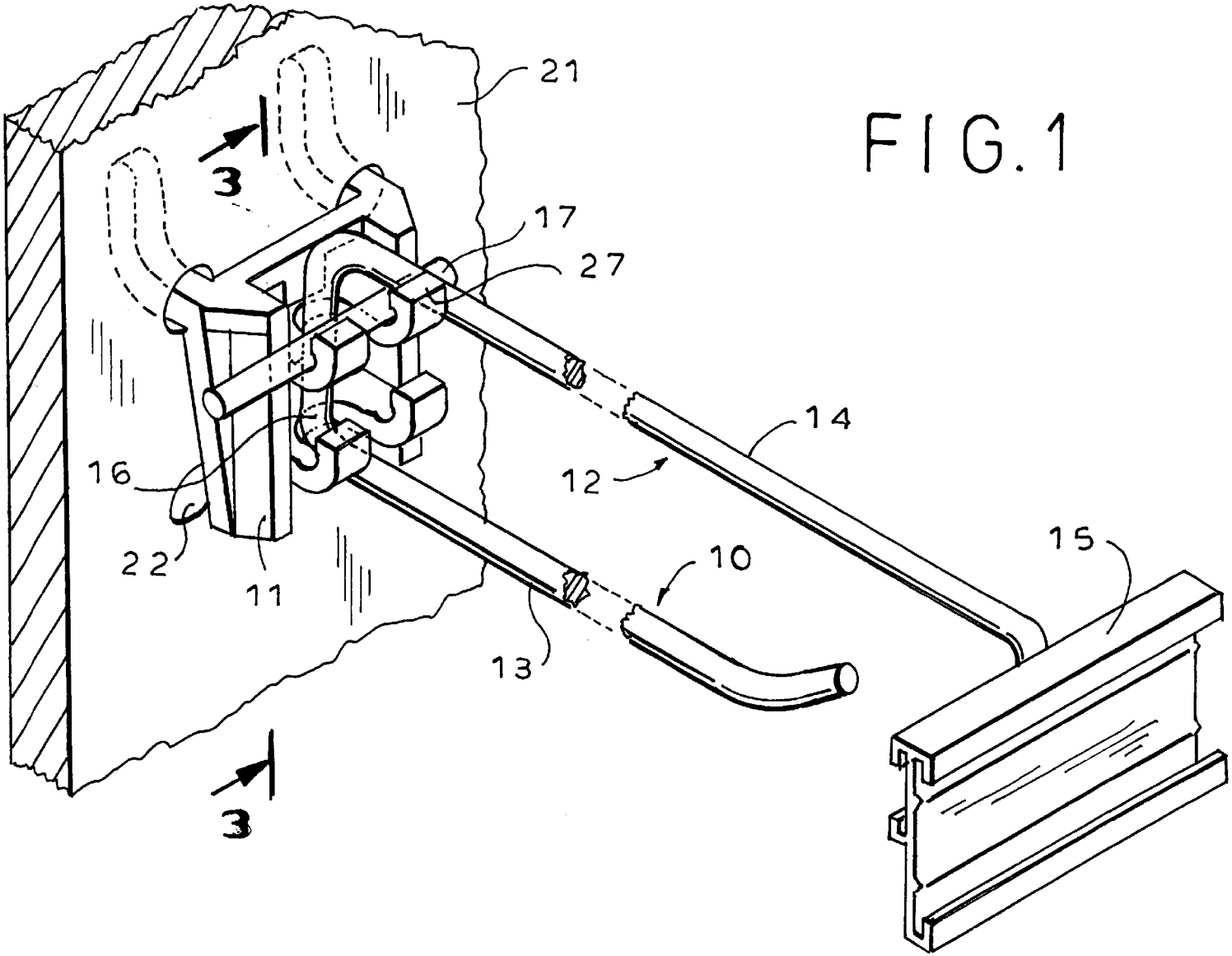
FIG. 1 is a front perspective view of one advantageous embodiment of an adjustably positionable display hook assembly according to the invention.

Referring now to the drawings, and initially to FIGS. 1–5 thereof, the reference numeral 10 designates generally a display hook assembly according to the invention. The display hook assembly consists of two principal components, a back plate 11 and a hook 12. In the illustrated and preferred form of the invention, the hook 12 is formed of metal wire and comprises a lower merchandise support arm 13 and an upper label support arm 14 arranged to mount a label holder 15 at its outer end.

The two arms 13, 14 of the display hook are formed of a single length of wire, and are joined by a generally vertical connecting portion 16.

Figure 3:
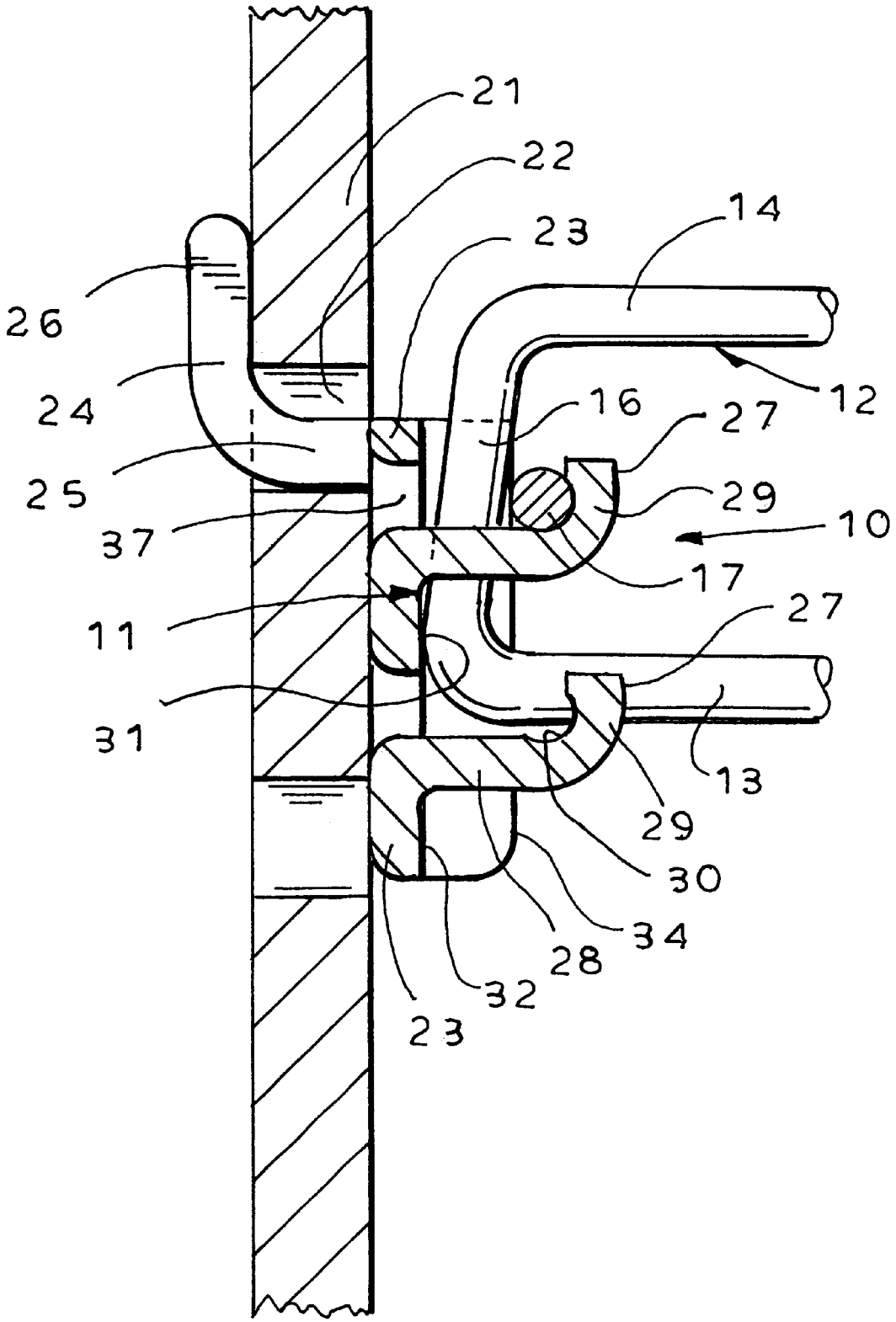
FIG. 3 is an enlarged, fragmentary cross sectional view as taken generally on line 3—3 of FIG. 1.

A short cross bar 17, typically formed of the same wire material as the body of the hook 12, is welded to a forwardly facing surface of the vertical connecting element 16, generally in FIGS. 1 and 3. The cross bar 17 is disposed at right angles to the vertical connecting portion 16 and extends horizontally in both directions.

The construction of the wire hook portion 12 is, per se, known and is used in other types of display hook assemblies. The new display hook assembly differentiates from the known devices in providing for a back plate member 11 arranged to mount the hook portion 12 in a plurality of positions in relation to the back plate, so as to accommodate variable positioning of the hook in relatively small increments with respect to an overall merchandise display structure.

With reference to FIG. 1, the reference numeral 21 designates an apertured panel board of a type widely used throughout the trade for the display of merchandise. The panel board 21 is provided with multiple rows and columns of openings 22, typically of about ¼ inch in diameter and spaced throughout the panel 21 on one inch centers, both vertically and horizontally.

In the illustrated and preferred form of the invention, the back plate 11 is a single piece molding of plastic material and comprises a back wall 23 and (typically) a pair of spaced apart L-shaped lugs 24. In the illustrated arrangement, the lugs 24 extend rearwardly from an upper edge portion of the back wall 23 and are comprised of rearwardly extending portions 25 and upwardly extending portions 26. The described arrangement of the L-shaped lugs 24 is typical and in widespread use. However, it is also possible for the mounting lugs 24 to be of an inverted L-shaped configuration as, for example, is described in my copending application Ser. No. 10/138,131, filed May 2, 2002 (0094-122P).

In accordance with the invention, the back plate 11 is provided with a plurality of pairs of socket-forming elements 27. These also are of generally L-shaped configuration, with generally horizontal portions 28 extending forwardly from the back wall 23 and generally vertical portions 29 extending upward from forward extremities of the horizontal portions 28. In the form of the invention illustrated in FIGS. 1–3, there are two vertically spaced pairs of socket-forming elements 27, which are vertically separated a distance of, for example, ½ inch.

As reflected in FIG. 3, the corner areas formed by the upper surfaces of horizontal portions 28 and inwardly facing surfaces of vertical portions 29 of the socket-forming elements are provided with arcuate recesses 30 of a size and shape to receive and seat a portion of the cross bar 17. Thus, as shown in FIG. 3, when the back plate 11 is properly mounted in the display panel 21, the hook member 12 may be supported in either one of two vertically spaced positions relative to the back plate by seating the cross bar 17 selectively seating into the upper pair or lower pair of socket-forming elements 27. When the cross bar 17 is seated in one of the pairs of socket-forming elements, a back surface portion 31 adjacent the lower end of the connecting portion 16, bears against a front surface 32 of the back wall. The cross bar 17 is fixed to the connecting portion 16 at a point spaced vertically above the back surface portion 31, such that the natural tendency of the hook to pivot in a clockwise direction (as viewed in FIG. 3) under its own weight as well as the weight of any display product, tends to urge the cross bar 17 firmly into the recesses 30 in which it is seated.

It is advantageous and desirable to lock the cross bar 17 in its installed position, to prevent accidental dislodgment. To this end, the back plate 11 of the invention includes a pair of abutment rails 33 which extend vertically down the front face of the back wall 23, at least in regions thereof directly opposite the upward extensions 29 of the socket-forming elements, and preferably continuously from top to bottom of the back plate. The forwardly facing abutment surfaces 34 of the abutment rails are spaced behind the upward extensions 29 of the socket-forming elements a distance slightly less than the diameter of the cross bar 17. Accordingly, in order to seat the cross bar in a selected pair of socket-forming elements 27, the cross bar must be pressed downwardly, deflecting the upward extensions 29 sufficiently to accommodate passage of the cross bar, and enabling the cross bar to be seated in the recesses 30 with somewhat of a snap action. Thus, once the cross bar 17 is snapped into the recesses 30, it is tightly and semi-permanently retained therein, and will remain assembled with the back plate 11 until intentionally separated therefrom.

As will be evident in FIG. 3, with the back plate 11 mounted in a fixed position on the apertured panel board 21, the hook 12 may be mounted in two different positions, separated by, for example, ½ inch, effectively doubling the number of possible vertical hook positions on a given display panel. This additional flexibility, under appropriate circumstances, enables a particular display panel to be more densely populated with display merchandise, which is an economically important objective of both store owners and their suppliers.

Figure 2:
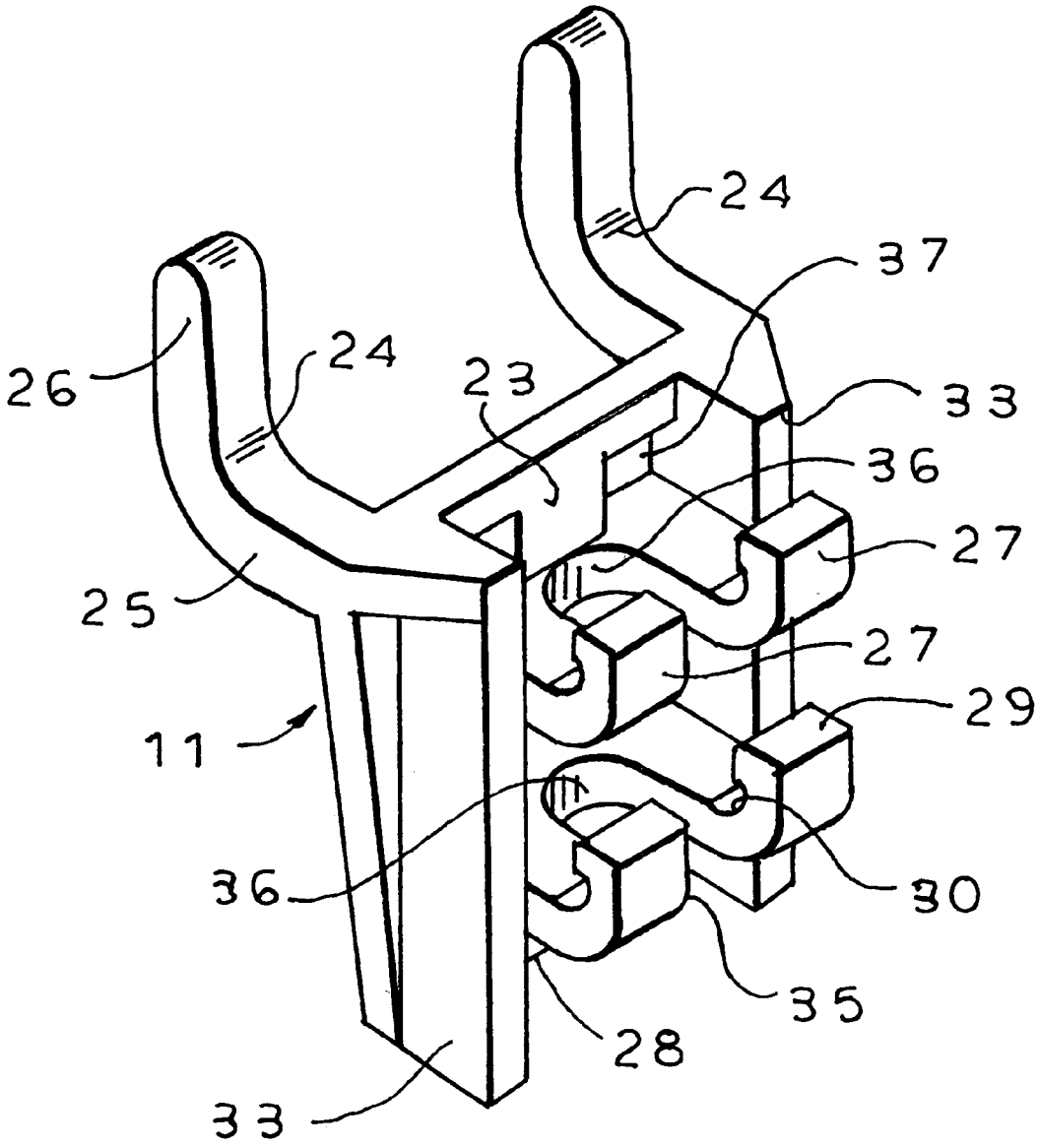
FIG. 2 is a perspective view of a back plate element, forming part of the assembly of FIG. 1.
Figure 4:
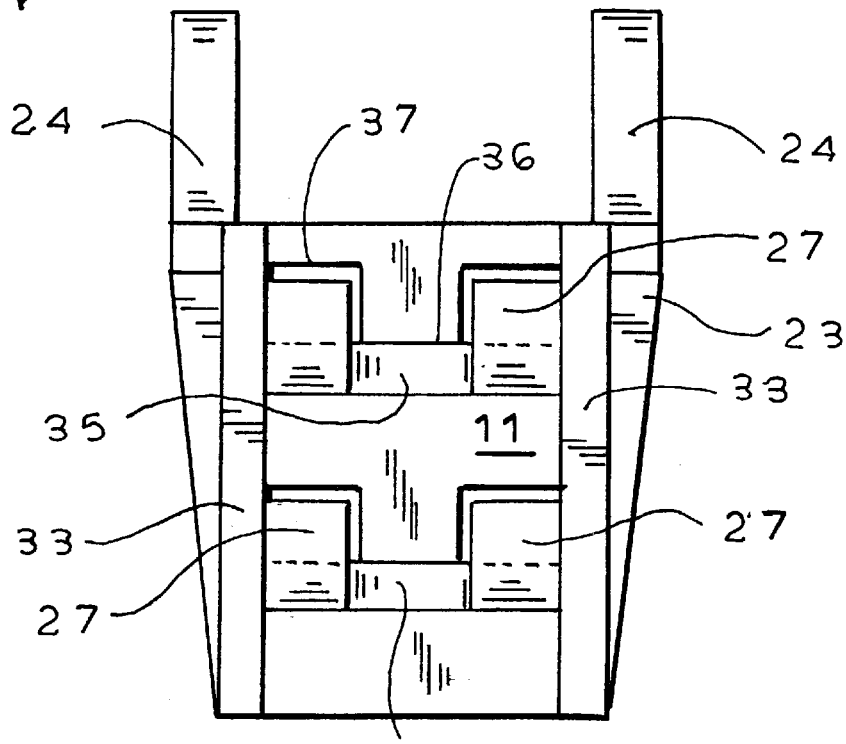
FIGS. 4 and 5 are front and back elevational views respectively of the back plate member of FIG. 2.
Figure 5:
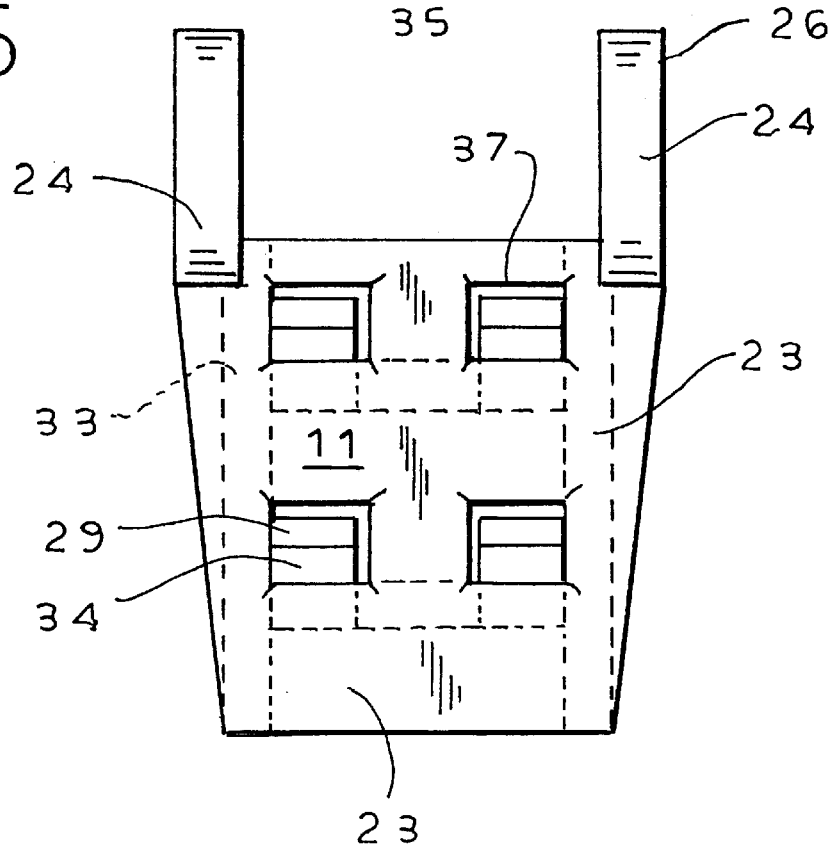

As reflected in FIGS. 2 and 4, a space 35 is formed between the respective socket-forming elements 27 of each pair. The width of the space 35 (between inside edges of the socket-forming elements) is typically slightly greater than the diameter of the largest size hook element 12 to be accommodated in the back plate 11. In this respect, the wire hook elements typically come in a variety of wire sizes, depending upon the projecting length of the hook, the expected weight of the merchandise intended to be displayed thereon, etc. When the wire of largest diameter is mounted in the backing plate, as reflected in FIGS. 1 and 2, the generally vertical connecting portion 16 is confined laterally within the space 35. Additionally, it is customary for the back portions 36 of the spaces 35 to be somewhat convergently contoured, so there is a tendency to automatically center wires of a diameter smaller than the largest. This frequently is desired in order to maintain an orderly appearance. Nevertheless, as will be explained hereinafter, it may be important and desirable in certain instances to provide for intentional lateral displacement of the hook member relative to the base plate.

In the illustrated embodiments of the invention, the back plate 11 is preferentially formed of a one-piece plastic molding of suitable structural plastic material. In order to accommodate mass production molding of the back plates without requiring costly multiple separation mold configurations, it is desirable that the back wall 23 be formed with openings 37 (FIG. 5) having a height and width at least equal to the height and width of the upwardly extending portions 29 of the socket-forming elements. With this arrangement, mold elements (not shown) for forming the rearwardly facing surfaces of the upward extensions 29 can be projected through the back wall 23 of the back plate and then withdrawn through the back wall 23 after molding has been completed, leaving the openings 37. The other features at the front of the back plate 11 are such as to provide a clear space between the openings 37 and the rearwardly facing surfaces of the upward extensions 29 of the socket-forming elements 27, in order to accommodate the presence of the retractable mold parts during the molding operation. Employing this construction feature greatly simplifies the mold structure and thus the mold cost, and therefore results in important cost reductions in the production of the part itself.

Figure 6:
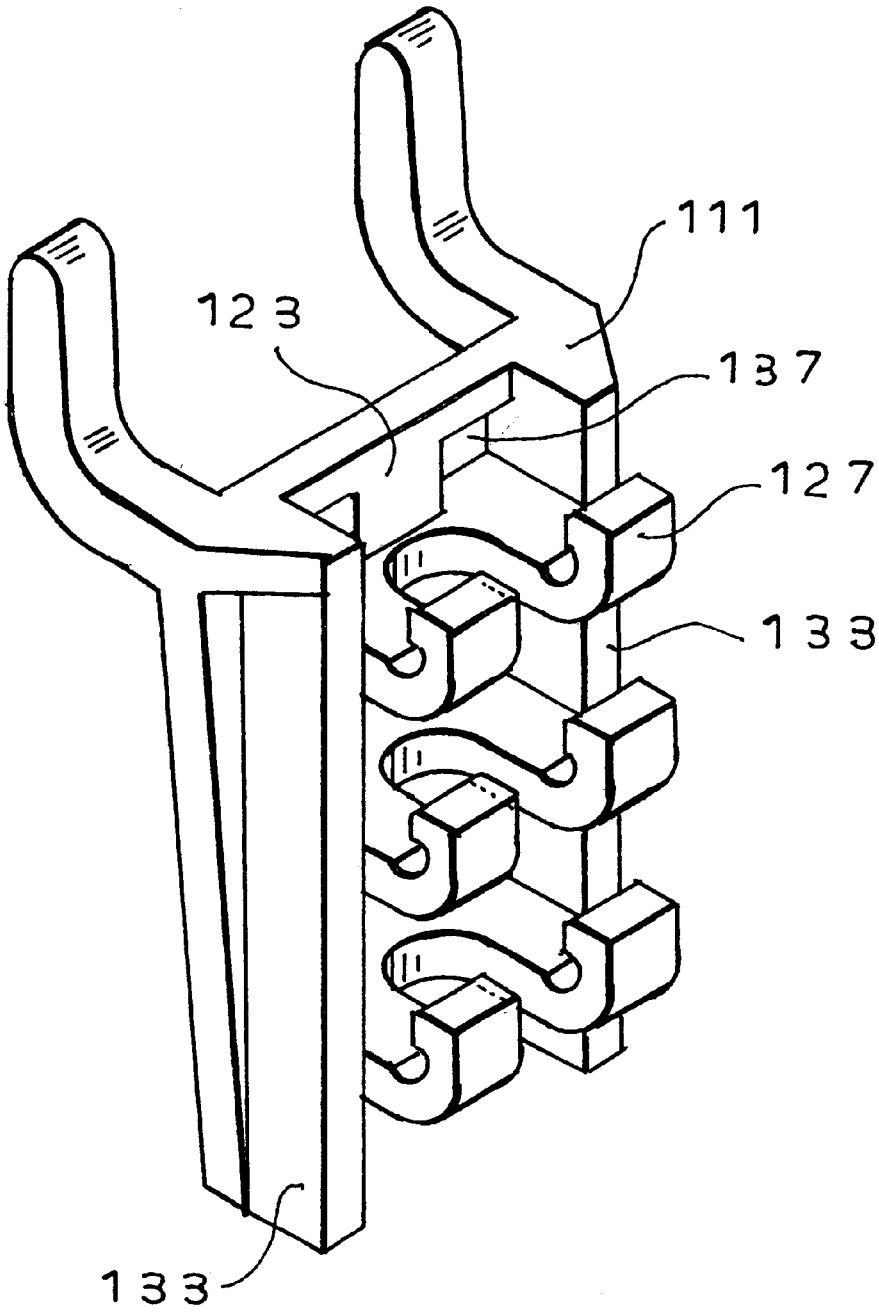
FIG. 6 is a front perspective view of a modified form of back plate member, constructed in accordance with the invention.

The form of the invention shown in FIG. 6 is in most respects similar to the described embodiment of FIGS. 1–5. In the embodiment of FIG. 6, however, there are three sets of vertically spaced socket-forming elements 127, which can be configured basically in the same manner as socket-forming elements 27 of FIGS. 1–5. The back plate member 111 of FIG. 6 is of somewhat greater vertical height overall than the back plate of FIGS. 1–5, in order to accommodate the three sets of socket-forming elements. Otherwise, the design and functioning of the back plate 111 is in all respects the same as that of the back plate 11 of FIGS. 1–5. The elements designated by the reference numerals 123, 133 and 137 in FIG. 6. correspond to the elements designated by reference numerals 23, 33 and 37 in FIGS. 1–5.

Figure 7:
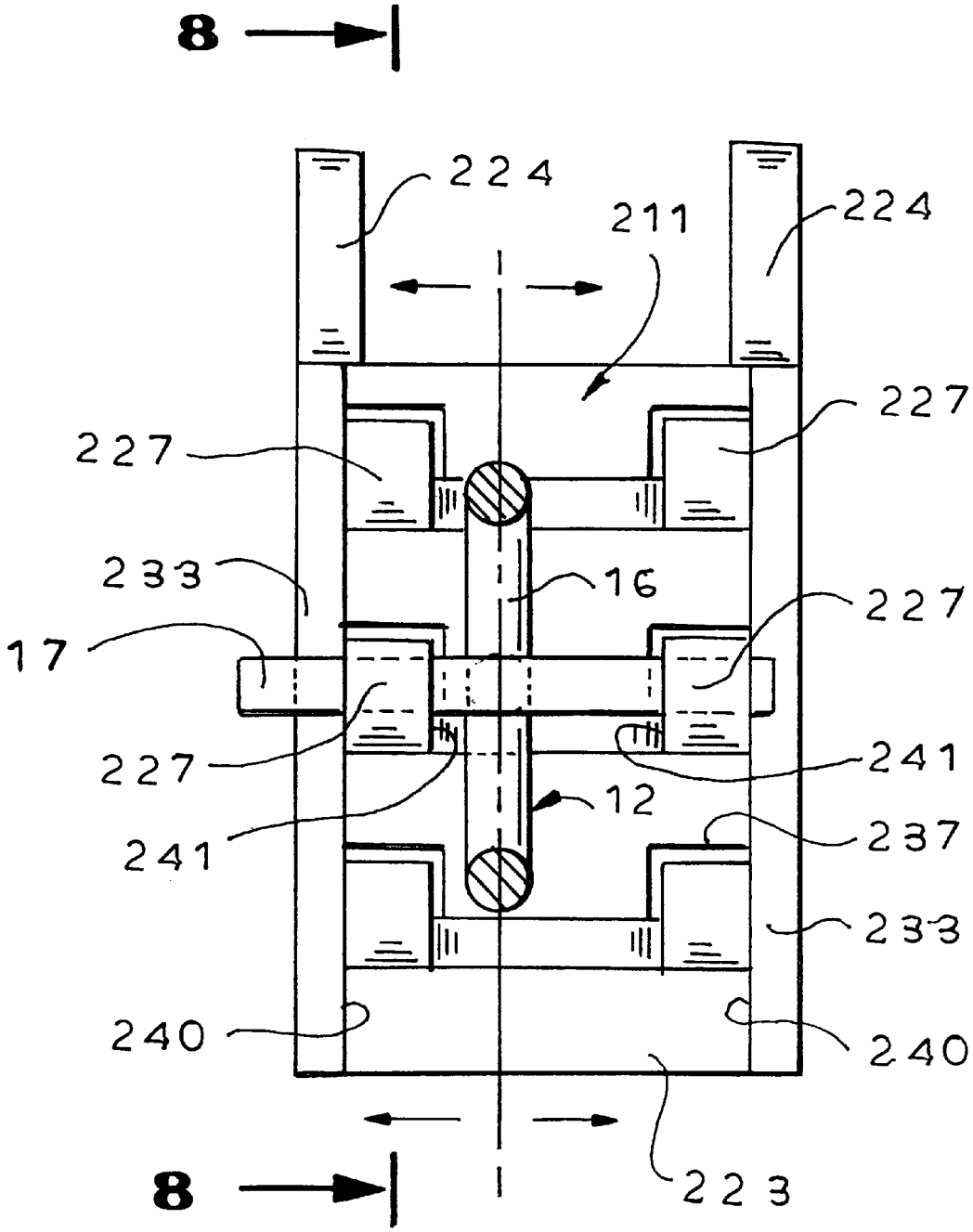
FIG. 7 is a front elevational view, with parts broken away, illustrating a further modified form of the invention for accommodating both lateral and vertical positional adjustment of a display hook.
Figure 8:
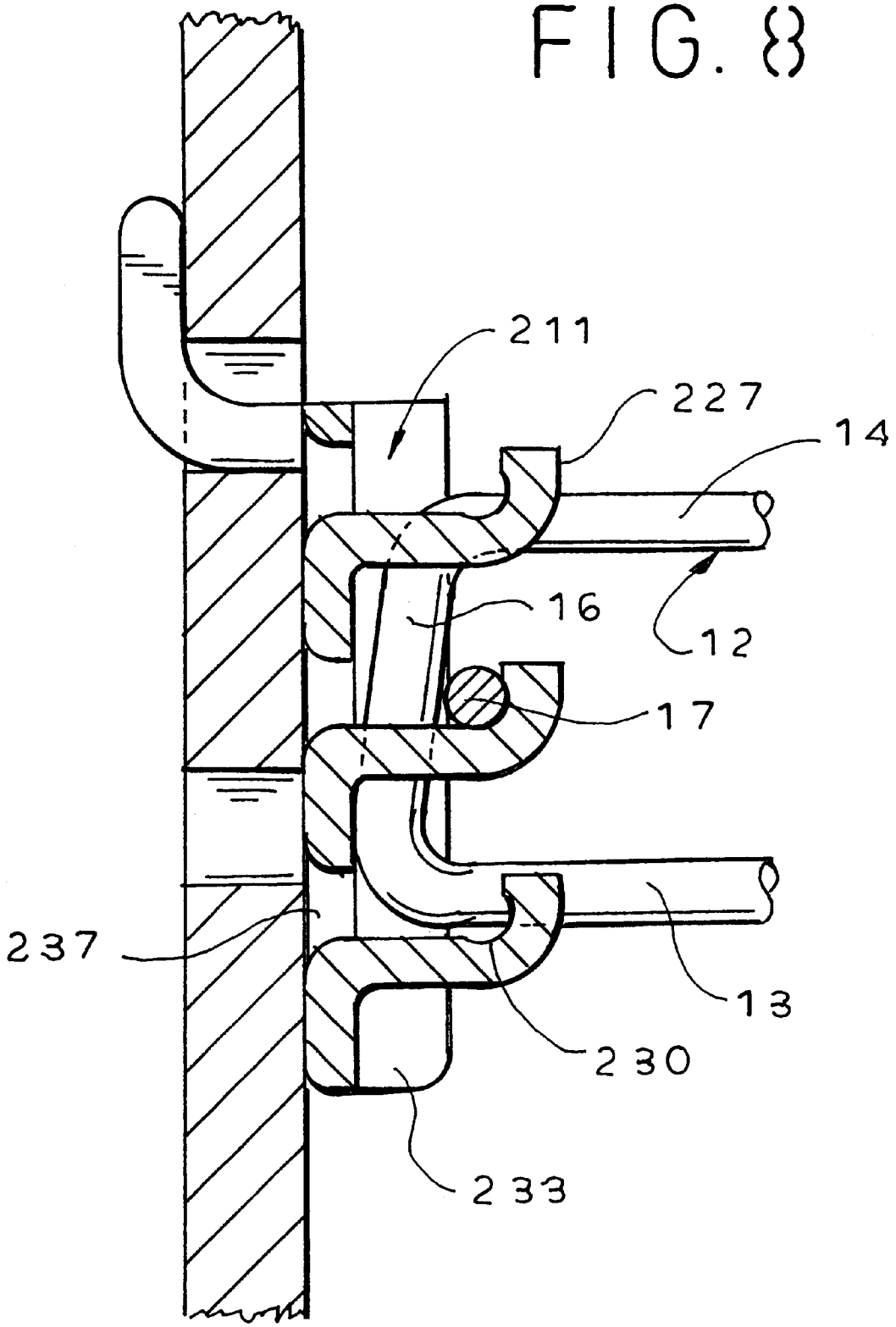
FIG. 8 is a cross sectional view as taken generally on line 8—8 of FIG. 7.

In the embodiment of FIGS. 7 and 8, a back plate 211 is formed with multiple pairs of socket-forming elements 227, similar to the modification of FIG. 6, but as shown in FIG. 7, the socket-forming elements are spaced apart laterally a much greater distance than is required for the accommodation of the wire hook member 12. The elements designated by the reference numerals 237 in FIG. 7 and 230 in FIG. 8 correspond to the elements designated by the reference numerals 37 and 30 in FIGS. 1–5.

As shown in FIG. 7, the mounting lugs 224 of the back plate are spaced apart the same distance as the lugs 24 of the previously described embodiment, the spacing of course being dictated by the spacing between openings in the apertured panel board. Spaced apart, vertically extending abutment rails 233 extend along the side edge extremities of the back wall 223, providing a substantial space, for example around 0.94 inch, between their respective inside surfaces 240. The socket-forming elements 227 of each pair are positioned tightly against the inside surfaces of the abutment rails 233. These socket-forming elements 227 have a typical width of for example about 0.205 inch, resulting in a space between socket-forming elements of each pair of slightly over ½ inch.

A wire hook 12, mounted in the back plate 211 of FIG. 7, may have a wire diameter of perhaps ⅛th inch, 3⁄16th of an inch, or in cases ¼ inch. Thus, there is substantial free space between the side edges of the vertical portion 16 of the hook and the inside edges 241 of a pair of socket-forming elements 227. This allows the frictionally gripped cross bar 17 to be adjustably positioned laterally to any position within the limits defined by the inside edges 241, as is evident in FIG. 7. The length of the cross bar 17 must be such, of course, as to remain engaged in the socket-forming elements 227 in any lateral position of the hook.

In the form of the invention shown in FIGS. 7 and 8, the back wall member 223 is constructed such that its overall width is the same as the spacing between outside edges of the mounting lugs 224. It would be possible, of course, to construct the back wall 223 to be somewhat wider than that, in order to provide an even greater degree of lateral adjustability of the metal hook 12.

In the embodiment of FIGS. 7 and 8, the space between inside edges 241 of the socket-forming elements preferably has no convergent contours at the back, as is the case of the embodiment shown in FIG. 2, for example. This assures that the hook will have a full range of lateral adjustment.

The display hook assembly of the invention, in any of its embodiments, provides a simple and inexpensive way to achieve a high degree of flexibility in display hook positioning on an aperture panel board, allowing positional adjustment in amounts significantly less than the one inch increments normally resulting from the standard spacing of the panel apertures. A back plate element may be constructed to provide a plurality of pairs of socket-forming elements, for mounting of a wire hook at several vertical locations on the back plate. Vertically adjacent pairs of socket-forming members may be quite closely spaced, as long as there is sufficient room between to insert the cross bar element 17.

In the embodiment of FIGS. 7 and 8, the back plate provides not only for a variety of vertical positions of the hook member in relation to the back plate, but also accommodates substantial lateral adjustment of the position of the hook relative to the back plate. This assures that in a given store display area, the density of displayed merchandise will be optimal, to maximize sales opportunity per a given area of panel display.

In addition to the above indicated functional advantages, the device of the invention, in its preferred embodiments, is capable of mass production by inexpensive injection molding techniques, with relatively simplified mold configurations. This provides for attractive economies in the manufacturing process, enabling the device to be marketed on a basis attractive to mass merchandisers.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A display hook assembly, which comprises (a) a display hook comprising an forwardly extending arm for the support of display merchandise, (b) a cross bar element fixed to said display hook and extending generally at right angles thereto, and (c) a back plate for mounting said display hook, (d) said back plate comprising a back wall member, (e) one of more panel engaging elements extending rearwardly from said back wall for mounting said back plate to a display panel, (f) said display panel having a plurality of incrementally discrete vertically spaced locations for receiving said panel engaging elements for mounting said back plate at predetermined vertically discrete locations on said panel, (g) said back plate further including a plurality of vertically spaced-apart socket-forming elements for receiving and detachably securing the cross bar element of a said display hook for mounting said display hook at one of a plurality of vertically spaced apart positions on said back plate, and (h) the vertical spacing between adjacent socket-forming elements of said back plate being less than the vertical spacing between said discrete vertically spaced locations on said display panel.

2. A display hook assembly according to claim 1, wherein (a) said socket-forming elements are integral with and extend forwardly from said back wall member.

3. A display hook assembly according to claim 2, wherein (a) said back plate is formed of a one-piece molding of plastic material, (b) said socket-forming elements are of generally L-shaped configuration, including a generally horizontally extending first leg portion and a generally vertically extending second leg portion at the forward end of said first leg portion, and (c) said back wall member having openings therein corresponding in height and width to height and width dimensions of said generally vertically extending second leg portions and aligned therewith in a front-to back direction.

4. A display hook assembly according to claim 3, wherein (a) said socket-forming elements include a generally vertically extending leg defining a rearwardly facing cross bar confining surface, (b) an abutment surface is formed on said back wall member and has a forwardly facing cross bar confining surface opposing said rearwardly facing cross bar confining surface on said generally vertically extending leg, and (c) opposing pairs of said rearwardly facing and forwardly facing cross bar confining surfaces are adapted to engage and releasably retain portions of a cross bar for mounting of said display hook.

5. A display hook assembly according to claim 4, wherein (a) arcuate recesses are formed in certain of said forwardly facing confining surfaces and said opposing rearwardly facing confining surfaces for engaging and retaining said cross bar with a snap action.

6. A display hook assembly according to claim 4, wherein (a) a plurality of abutment surfaces are formed by a single, vertically extending abutment rail extending in opposed relation to each of a plurality of vertically spaced socket-forming elements.

7. A display hook assembly according to claim 2, wherein (a) said socket-forming elements are of generally L-shaped configuration, including a generally horizontally extending first leg portion and a generally vertically extending second leg portion at the forward end of said first leg portion, and (b) said second leg portions are formed with rearwardly facing grooves therein for receiving portions of said cross bar element.

8. A display hook assembly according to claim 7, wherein (a) an abutment rail is integral with and projects forwardly from said back wall member closely adjacent to said socket-forming elements and extends vertically in the mounted orientation of said back plate, and (b) said abutment rail has a forwardly facing surface spaced inwardly from said second leg portions and cooperating therewith to releasably engage the cross bar element of a display hook.

9. A display hook assembly according to claim 8, wherein (a) said back plate includes a pair of horizontally spaced apart abutment rails positioned on opposite sides of a socket-forming element.

10. A display hook assembly according to claim 8, wherein (a) said abutment rail is formed with a forwardly facing groove aligned in opposed relation to the rearwardly facing groove in said socket-forming element, whereby said cross bar element is gripped with a snap action between an opposed pair of such grooves.

11. A display hook assembly according to claim 2, wherein (a) said socket-forming elements are of generally L-shaped configuration, including a generally horizontally extending first leg portion and a generally vertically extending second leg portion at the forward end of said first leg portion, (b) said socket-forming elements are formed in horizontally spaced apart pairs defining an open space between, (c) said back wall member has a plurality of openings therein with height and width dimensions at least as great as height and width dimensions of said generally vertically extending second leg portions and aligned therewith in a front-to back direction, and (d) a front surface of said back plate is spaced rearwardly with respect to rearwardly facing surfaces of said second leg portions to form a clear space between each of said openings and the second leg portion aligned therewith.

12. A display hook assembly according to claim 1, wherein (a) at least three vertically spaced levels of socket-forming elements are formed on said back wall members.

13. A display hook assembly according to claim 1, wherein (a) said display hook comprises a single forwardly extending arm for the support of display merchandise, and includes a generally downwardly extending inner end portion, (b) said cross bar element is fixed to said display hook at or adjacent said inner end portion thereof and extends horizontally in both directions therefrom, (c) said socket-forming elements are arranged in horizontally spaced-apart pairs for receiving portions of said cross bar element on opposite sides of said display hook, and defining an open space between, and (d) the inner end portion of said hook extends downward in one or more of said open spaces between horizontally spaced apart pairs of said socket-forming elements.

14. A display hook assembly according to claim 13, wherein (a) said display hook is provided in a plurality of thicknesses for support of products of different size and weight, and the inner end portion of said display hook has a predetermined width dimension, and (b) said open spaces are of a width substantially greater than the predetermined width dimension of the largest size display hook, whereby said display hook may be adjustably positioned laterally with respect to the base plate when the cross bar element thereof is mounted in a horizontally spaced apart pair of socket-forming elements.

15. A display hook assembly according to claim 1, wherein (a) said display panel is an apertured panel of the type having a plurality of openings arranged in rows and columns for reception of said panel-engaging elements.

* * * * *